US010435198B2

(12) United States Patent
Turcotte

(10) Patent No.: US 10,435,198 B2
(45) Date of Patent: Oct. 8, 2019

(54) RECESSED CONTAINER CLOSURE AND METHOD OF INCREASING ADVERTISING SPACE ON A CONTAINER USING A RECESSED CONTAINER CLOSURE

(71) Applicant: Robert Turcotte, Roanoke, VA (US)

(72) Inventor: Robert Turcotte, Roanoke, VA (US)

( * ) Notice: Subject to any disclaimer, the term of this patent is extended or adjusted under 35 U.S.C. 154(b) by 0 days.

(21) Appl. No.: 15/819,575

(22) Filed: Nov. 21, 2017

(65) Prior Publication Data

US 2018/0134450 A1 May 17, 2018

Related U.S. Application Data

(62) Division of application No. 14/011,204, filed on Aug. 27, 2013, now abandoned.

(60) Provisional application No. 61/693,825, filed on Aug. 28, 2012.

(51) Int. Cl.

| | |
|---|---|
| ***B65D 25/00*** | (2006.01) |
| ***B65D 39/00*** | (2006.01) |
| ***B65D 39/02*** | (2006.01) |
| ***B65D 39/08*** | (2006.01) |
| ***B65D 43/02*** | (2006.01) |
| ***G09F 23/00*** | (2006.01) |

(52) U.S. Cl.

CPC ..... *B65D 25/00* (2013.01); *B65D 39/00* (2013.01); *B65D 39/02* (2013.01); *B65D 39/08* (2013.01); *B65D 43/021* (2013.01); *B65D 43/0229* (2013.01); *G09F 23/00* (2013.01); *B65D 2203/02* (2013.01); *B65D 2543/0049* (2013.01); *B65D 2543/00277* (2013.01); *B65D 2543/00287* (2013.01); *B65D 2543/00296* (2013.01); *B65D 2543/00425* (2013.01)

(58) Field of Classification Search

CPC ..... B65D 39/00; B65D 39/02; B65D 39/08; B65D 43/021; B65D 43/0229; B65D 25/00; G09F 23/00

See application file for complete search history.

(56) References Cited

U.S. PATENT DOCUMENTS

| | | | | |
|---|---|---|---|---|
| 44,054 A * | 8/1864 | Thompson | ..... | B65D 39/12 215/360 |
| 698,217 A * | 4/1902 | Newton | ..... | B65D 39/084 220/288 |
| 1,415,908 A * | 5/1922 | Tofting | ..... | B65D 39/08 215/231 |

(Continued)

*Primary Examiner* — Paul R Durand
*Assistant Examiner* — Randall A Gruby
(74) *Attorney, Agent, or Firm* — New River Valley IP Law, P.C.; Michele L. Mayberry

(57) ABSTRACT

The present invention relates to maximizing advertising space on product packaging. Embodiments of the present invention relate to a method of increasing advertising space on various product packaging by increasing the graphic space on and apparent volume of the packaging, such as those used for cosmetics and toiletries. Preferred embodiments include a product packaging with a partially or completely recessed container closure. Further preferred embodiments include a container closure that is threaded, fused, or snapped in to the body of the container. Embodiments of the invention can be modified to accommodate existing products or provide a unique package design for emerging products.

13 Claims, 5 Drawing Sheets

(56) References Cited

U.S. PATENT DOCUMENTS 1,890,194 A * 12/1932 Punte ..... B65D 43/161 220/254.3
1,894,575 A * 1/1933 Sherman ..... B65D 43/161 220/254.3
3,398,847 A * 8/1968 Towns ..... B65D 50/069 215/216
3,412,759 A * 11/1968 Potter ..... F16L 55/132 138/89
3,473,681 A * 10/1969 Hall, Jr. ..... B65D 50/067 215/203
3,556,331 A * 1/1971 Towns ..... B65D 55/02 215/213
3,811,590 A * 5/1974 Hall, Jr. ..... B65D 50/067 215/207
3,985,146 A * 10/1976 Albach ..... A45D 27/00 132/289
3,993,102 A * 11/1976 Polster ..... F16L 55/115 138/89
4,407,423 A * 10/1983 Walter ..... B65D 47/0838 220/260
4,457,458 A * 7/1984 Heinol ..... B65D 47/0838 16/227
4,496,069 A * 1/1985 Winkless ..... B65D 47/0838 220/260
D334,709 S * 4/1993 Fleming ..... D9/449
5,285,917 A * 2/1994 Hoffmann ..... B65D 50/069 215/211
5,356,030 A * 10/1994 Budenbender ..... B65D 39/082 220/288
6,152,322 A * 11/2000 Marino ..... B65D 47/0852 206/812
6,279,775 B1 * 8/2001 Parkes ..... A47K 10/3818 221/185
7,445,169 B2 * 11/2008 Young ..... A01C 7/02 222/532
2002/0180114 A1 * 12/2002 Cargile ..... B29C 49/24 264/524
2003/0077104 A1 * 4/2003 Schrepf ..... A45D 34/045 401/129
2005/0040169 A1 * 2/2005 Son ..... B65D 25/465 220/254.3
2005/0051574 A1 * 3/2005 Kesselman ..... B65D 35/08 222/107
2005/0087543 A1 * 4/2005 Smith ..... B65D 43/0212 221/63
2005/0190070 A1 * 9/2005 Rudduck ..... B65D 39/12 340/693.5
2005/0252929 A1 * 11/2005 Bond ..... A47J 41/0094 222/23
2006/0157487 A1 * 7/2006 Rosendahl ..... B65D 39/08 220/304
2009/0065528 A1 * 3/2009 Bray ..... B65D 35/44 222/107
2009/0139884 A1 * 6/2009 Kim ..... B65D 35/12 206/277
2011/0198352 A1 * 8/2011 Lown ..... A47G 19/12 220/254.8
2014/0117056 A1 * 5/2014 Branyon ..... B31C 1/04 222/568

* cited by examiner

RECESSED CONTAINER CLOSURE AND METHOD OF INCREASING ADVERTISING SPACE ON A CONTAINER USING A RECESSED CONTAINER CLOSURE

CROSS-REFERENCE TO RELATED APPLICATIONS

The present application claims priority to and is a Divisional of parent application U.S. patent application Ser. No. 14/011,204 filed Aug. 27, 2013 and published as U.S. Patent Application Publication No. 20140061250 on Mar. 6, 2014, which parent application claims priority to and the benefit of the filing date of U.S. Provisional Application No. 61/693,825, filed Aug. 28, 2012. The disclosures of each of these applications are hereby incorporated by reference herein in their entireties.

BACKGROUND OF THE INVENTION

Field of the Invention

The present invention relates to product packaging and methods of increasing advertising space on product packaging. More specifically, embodiments of the present invention relate to a method of increasing advertising space on product containers by increasing the graphic space and apparent volume of a product container, while maintaining actual volume. Preferred embodiments include product packaging having a container with a partially or completely recessed container closure.

Description of Related Art

Product packaging is a key component of how successful a product is for a company. It allows the consumer to develop brand recognition and encourages the consumer to choose one company's product over their competitor's. The shape and the size of the container, the closure or dispenser, and the color and graphics displayed are all factors in determining how to make a product most marketable. Every year, companies spend billions of dollars designing, researching, and analyzing how products will look and how the product packaging can entice the consumer into purchasing the product.

For example, shampoo displayed on the shelves of a big box store may take up an entire aisle of shelf space and may provide hundreds of options for the consumer. Making a selection in the face of so many possible choices can be overwhelming. Thus, the consumer's ultimate choice may be affected by only a couple of factors, including the apparent volume of product for a given price or attention-grabbing graphic designs. Although a package may contain the same volume or amount of product as a competitor's package, it has been found that a shorter package with a complex shape is less likely to be selected by the consumer in favor of a taller package, such as a package with a higher aspect ratio for the front-facing panel. Likewise, consumer-connecting, aesthetically pleasing graphics are easier to provide on a package having an enlarged front-facing surface area.

When a consumer views a number of similar products on a store shelf, a deciding factor of which item they will ultimately purchase is what the value, or apparent value, of the product is. In other words, the consumer will select the product that provides the most for their money. Typically, the product that has the greater apparent volume is the one favored by the consumer, which is generally determined by the size and shape of the product container. Conventional containers, such as those used in the cosmetics industry, generally comprise a container body and some kind of cap or closure, the body of which is typically externally threaded and connects with the internally threaded cap. The volume of the packaging is typically judged by the consumer based on the container body alone without the cap or closure. This view is further emphasized by the graphic displayed on the container which is usually only disposed on the container body. The printable area of a container is typically limited to the container body and not the cap or dispenser due to current manufacturing techniques. For example, the container body and closure are usually made of different materials, by different manufacturing methods, and are usually brought together to form the product packaging once the container body is imprinted with the desired graphic. Since the graphic is not continued onto the cap, this interruption in graphic space makes the package appear smaller, and implies less product by volume even though the actual volume remains the same.

Some manufactures have attempted to increase the apparent product volume by using graphics that are disposed over the entire body and cap of a product container. This is usually achieved by a method of printing on a material other than the container itself and shrink-wrapping the printed graphic over a conventional product container and closure. Although the graphic has been extended beyond the body of the container to the cap, the consumer can still notice the distinction of where the body and the cap meet and may still judge the apparent product volume based on the container body alone, even though the graphic has been continued onto the cap.

Other manufacturers have sought different ways to increase promotional space yet still use a conventional container shape. One such example is International Patent Application Publication No. WO 2007/074953A1 entitled, "Stopper Having Handle Grip" which is hereby incorporated by reference herein in its entirety. This container increases the advertising space available on the packaging by adding additional printable surface area to the cap. Although the overall promotional space available on the packaging has been increased, as compared with a packaging not having the advantage of the modified cap, the printable surface area of the container body itself remains the same as well as the aspect ratio and/or the height of the forward-facing portion of the container body (the packaging minus the cap). Thus, even with the modifications to the cap, the apparent volume of the container body does not change and the cap and container body remain separate and distinct parts of the packaging.

Some containers exist that eliminate or minimize the distinction between the container body and the cap, providing an overall more uniform container. One way to minimize the impact of the transition between the cap and the container body is to provide the cap and container body in the same or very similar colors. Monochromatic packaging tends to disguise the existence of a separate cap, but does not eliminate the distinction.

Another way to minimize the presence of a cap is disclosed in U.S. Pat. No. 6,782,999, entitled "Toothbrush Travel System," which is hereby incorporated by reference herein in its entirety. This container comprises an internally threaded container body and an externally threaded cap, however, the overall cap is provided in two parts and, in its entirety, the presence of the cap is not minimized.

From the above discussion, it can be appreciated that there exists a continuing need for new and improved containers, when such containers greatly impact consumer choices. It is especially apparent that what is desired is product packaging having a maximized amount of advertising space as compared with conventional product packaging. Further, there is a specific need and desire for product packaging having an increased apparent volume, while maintaining the same overall packaging volume or size and/or the container body size. What is desired is product packaging comprising a container body and cap, where the cap is completely recessed within the container body such that the cap is not detectable from certain views of the product, including the front-facing view of the product displayed on a shelf for sale.

SUMMARY OF THE INVENTION

The numerous limitations inherent in conventional product containers as described above provides great incentive for a new, and better method of increasing advertising space on containers. To this end, the present invention relates to increasing advertising space on the forward-facing portion of product packaging without increasing the overall size or volume of the product packaging.

An aspect of the invention provides a method of increasing advertising space on product packaging by increasing the graphic space and/or apparent volume of the container body, such as those used for cosmetics and toiletries.

Preferred embodiments include product packaging comprising a container body with a partially or completely recessed container closure or cap. This can be achieved by having a container body that is internally threaded with an externally threaded cap, whereby the cap screws into, as opposed to onto, the container body. In the context of this specification, it is not critical where the closure, such as the cap or dispenser, is disposed relative to the container body. For example, the closure may be disposed at the top of the container body, or on the bottom or any side of the container body.

Further preferred embodiments include product packaging having an increased advertising space and increased apparent volume by securing the cap or closure to an internal surface of the container body. This results in an increased apparent volume of the product packaging as compared with similar product packaging having the cap secured to an external surface of the container body.

Another aspect of embodiments of the invention is product packaging comprising a container body and cap, where the cap is completely recessed within the container body such that the cap is not detectable from certain views of the product, including the front-facing view of the product displayed on a shelf for sale. Although increasing space on the front-facing portion of the packaging is highly desired, by modifying the packaging according to embodiments of the invention other faces of the packaging or container body may also be enlarged, such as the rear-facing or side-facing portions. It may be desirable for some applications, such as for 360° displays, to focus on enlarging rear- or side-facing panels as well.

Other aspects of the invention include a product packaging wherein the connection between the component parts, the container body and the lid, appears continuous and provides for the appearance of an overall uniform container configuration. In embodiments of the invention, the horizontal line formed by the junction between the cap and container body can be eliminated. The continuous vertical space obtained by eliminating this vertical line enhances the perception of height.

A uniform packaging configuration allows for the entire container body surface to be used as uninterrupted graphic space, by removing the distinct and distracting junction between the cap and body. By removing the junction that separates the packaging into two separate parts, the visual implication of less volume in the container is also removed, effectively increasing the apparent volume of the container, even though the actual volume remains the same or substantially the same. The cap and container body of packaging embodiments of the invention may be configured in any manner that provides a uniform container construction.

An additional aspect of the invention provides product packaging comprising: (a) a container body with a selected height, the container body comprising an opening operably configured for receiving a cap; (b) a cap operably configured to provide for connection with the opening of the container body and having a top surface; (c) wherein, when the container body and cap are connected as product packaging, a portion of the cap is recessed into the container body leaving an exposed portion of the cap, such that the exposed portion of the cap has a height of less than one-tenth of the selected height of the container body. In preferred embodiments, the top surface of the cap has no through hole.

In embodiments where the cap comprises a pump component, there may be a through hole in the top surface of the cap to accommodate a draw tube for drawing product up from the container body into the pump to be dispensed to the consumer. The pump can comprise structure for engaging and interlocking with corresponding structure on the cap to provide for the pump in a recessed, locked and inactive position within the cap. Such a configuration will provide for a more streamlined appearance, lower profile cap, and smaller overall packaging height than with the pump in an extended, unlocked and active position. Providing product packaging that is more compact but which has the same volume also provides the benefit of taking up less shelf space, or room when shipping product.

Aspects of the invention further comprise product packaging with a container body and cap, wherein a uniform body shape is achieved by the cap being recessed in the body of the container. By having the cap recessed in the container body, the cap function of securing the contents of the container body is achieved and simultaneously a more streamlined structure is provided. The cap may be recessed within the container in any manner, such as a threaded cooperation where the container body provides a "female" connector and the cap provides a "male" connector, or the reverse.

Embodiments may further comprise a cap or closure that is recessed in the body of the product container by means of an internally threaded container body and an externally threaded cap. In this embodiment the "male" connector cap screws down into the "female" body of the container. Additionally, the cap may comprise any type of threading on any length of the cap.

Another embodiment comprises a container body and cap recessed in the body of the container and further comprises a cap that is fused into the container. The cap may be fused within the container by any means such as various heating processes, adhesive, etc.

Other embodiments can include a container comprising a body with a recessed cap wherein the cap is snapped into the body of the container. The cap may be tapered or straight fitting within the container body. The cap can also be optionally configured to push into the container but have the inability to be removed or pulled out once inserted. One example of this can be achieved by a container body comprising a ledge or similar structure within the interior and a cap comprising a tab or other cooperating structure, such that once the cap is inserted far enough within the container to cause engagement between the ledge and tab, the cap will be retained in the container body. Likewise, the cap can comprise a lip that fits with a recess in the interior of the container body thus preventing the cap from being dislodged once inserted. The cap is not limited to these examples and may comprise any mechanism for snapping or locking the cap into the container body.

Embodiments of various recessed cap containers may further comprise a recessed cap with a flip cap closure to aid in dispensing of the material housed in the container body. The flip cap, or flip up cap, can be disposed on any recessed cap such as a screw cap, fused cap, snap in cap, etc. The flip up cap can be fully or partially recessed in the container as long as it can still be accessed by the user. For example, the cap may be completely recessed within the container body, while a portion of the flip up lid hangs over the side of the container. This portion of the flip up lid, such as a tab, can be disposed on the back side of the container so that the front facing surface of the container body is the only portion of the product packaging taking up height on the packaging. The user may open the flip cap by placing a finger into a small cut out or dimple in the side of the container to reach the side of the flip up cap.

Additionally, embodiments of recessed cap containers may comprise a pump, also referred to as a finger or hand pump. The cap may be recessed by any means including a screw cap, fused cap, snap in cap, etc. By adding a pump with a recessed cap to dispense the contents, the entire packaging with the pump is significantly shorter than conventional pump-type packaging, the forward-facing surface of the container can be enlarged to occupy space consumed by the cap, while the actual volume of the container body remains the same. The shorter pump is less visually distracting and shifts attention to the container body.

Specific aspects of the invention include Aspect 1, which is a product packaging comprising: (a) a container body with a selected height, the container body comprising an opening operably configured for receiving a cap; (b) a cap operably configured to provide for connection with the opening of the container body and having a top surface with no through-hole; (c) wherein, when the container body and cap are connected as product packaging, a portion of the cap is recessed into the container body leaving an exposed portion of the cap, such that the exposed portion of the cap has a height of less than one-tenth of the selected height of the container body.

Further included is Aspect 2, which is the product packaging of Aspect 1, wherein the container body opening comprises an internal surface that is threaded and the cap comprises an external surface that is cooperatively threaded for connection with the container body opening.

Another embodiment is Aspect 3, which is the product packaging of Aspect 1 or Aspect 2, wherein the container body and cap are connected in a fused manner. Aspect 4 is the product packaging of Aspect 1 or 2, wherein the container body and cap are connected by being snapped together. Aspect 5 is the product packaging of Aspect 1 or 2, wherein provided by or in the top surface of the cap is a flip cap dispenser. Even further, Aspect 6 is the product packaging of Aspect 1 or 2, wherein the cap further comprises a finger pump dispenser, is also included within the scope of the invention. Aspect 7 is the product packaging of Aspect 1, wherein the cap is completely recessed into the container body and the cap adds no height to the product packaging.

Aspect 8 is a product packaging comprising: (a) a container body with a selected height, the container body comprising an opening with a threaded internal surface operably configured for receiving a cap; (b) a cap with an external surface that is threaded in a manner to provide for connection with the threaded internal surface of the container body opening, and which external surface comprises a cap top with no through-hole; (c) wherein, when the container body and cap are connected, a portion of the cap is recessed into the container body leaving an exposed portion of the cap, such that the exposed portion of the cap has a height of less than half of the selected height of the container body.

Aspect 9 is the product packaging of Aspect 8, wherein the exposed portion of the cap has a height of less than one-fourth of the selected height of the container body. Aspect 10 is the product packaging of Aspect 9, wherein the exposed portion of the cap has a height of less than one-fifth of the selected height of the container body. Aspect 11 is the product packaging of Aspect 8, 9, or 10, wherein the cap top is a flip cap. Aspect 12 is the product packaging of Aspect 8, 9, or 10, wherein the cap comprises a pump.

Aspect 13 is a method of preparing product packaging with an increased front-facing surface area, the method comprising providing a product packaging with the same height and actual volume as an existing packaging, but with an increased container body height and recessed cap.

Aspect 14 is a method of advertising on product packaging comprising modifying product packaging with a cap secured to an external surface of its container body by retrofitting the packaging to comprise a cap secured internally to the container body to increase printable surface area on the container body.

Aspect 15 is the method of Aspect 14, wherein the container body height is not modified and overall height of the packaging remains the same. Aspect 16 is the method of Aspect 14, wherein the container body height is increased and overall height of the packaging remains the same.

Aspect 17 is the product packaging of Aspect 2, wherein the container body and cap are connected in a fused manner. Aspect 18 is the product packaging of Aspect 2, wherein the container body and cap are connected by being snapped together. Aspect 19 is the product packaging of Aspect 2, wherein provided by or in the top surface of the cap is a flip cap dispenser. Aspect 20 is the product packaging of Aspect 2, wherein the cap further comprises a finger pump dispenser.

Aspect 21 is the product packaging of Aspect 9, wherein the cap top is a flip cap. Aspect 22 is the product packaging of Aspect 9, wherein the cap comprises a pump. Aspect 23 is the product packaging of Aspect 10, wherein the cap top is a flip cap. Aspect 24 is the product packaging of Aspect 10, wherein the cap comprises a pump.

BRIEF DESCRIPTION OF THE DRAWINGS

The following drawings illustrate certain aspects of some embodiments of the invention, and should not be used to limit or define the invention. Together with the written description, the drawings serve to explain and illustrate certain principles of the invention.

FIG. 4A is a "closed top view" and FIG. 4B is an "open side view" of FIG. 4A, FIG. 4C is a "closed top view" and FIG. 4D is an "open side view" of FIG. 4C.

DETAILED DESCRIPTION OF PREFERRED EMBODIMENTS

Figure 1A:
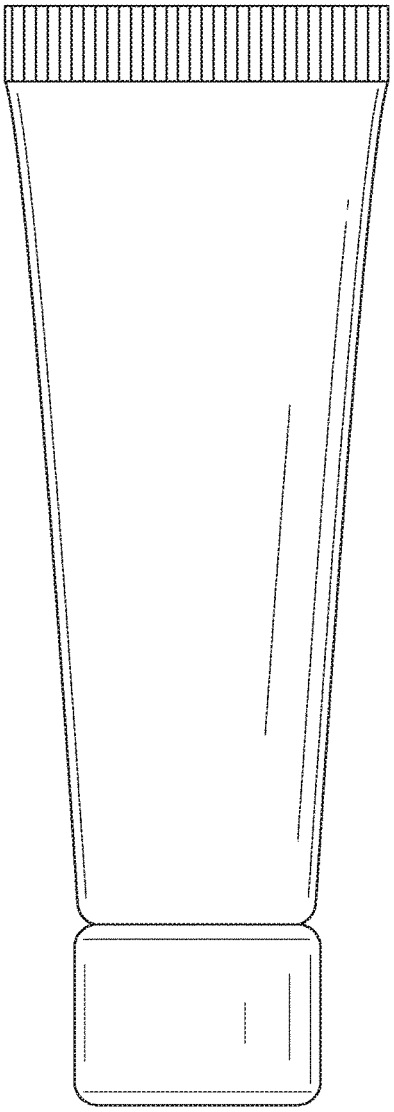
FIG. 1A PRIOR ART
FIGS. 1A-B are images providing a comparison between a conventional product packaging (FIG. 1A) and an embodiment of the invention (FIG. 1B), illustrating the increased advertising space on the container body when the cap is recessed.

Reference will now be made in detail to various exemplary embodiments of the invention. It is to be understood that the following discussion of exemplary embodiments is not intended as a limitation on the invention. Rather, the following discussion is provided to give the reader a more detailed understanding of certain aspects and features of the invention.

Product packaging is usually designed to provide advertising space on the packaging capable of attracting consumer attention and encouraging a sale. Product packaging in certain circumstances can be the equivalent of a mini-billboard. Each product package provides an opportunity for the manufacturer to connect with the consumer on an artistic or aesthetic level. The greater the space available for advertising on the package face(s), especially the front-facing portions, the greater impact to consumers the product will have on the shelf as a mechanism for promoting the product.

Along these lines, product packaging can be designed such that when the products are grouped together a larger billboard is provided to direct consumer attention to a grouping of products. One creative method of attracting consumer attention to a group of products includes designing the packaging with printed matter strategically arranged on the face and/or sides of the package in a manner that each package adds to a larger picture when the products are grouped together on a shelf or when stacked. To provide the aggregate with a seamless, continuous appearance similar to that of a billboard, the area of the front-facing portion of each product needs to be maximized. This is a simple task for box type packages, but for packages with a dispenser or cap, aggregation in this manner may not achieve the same dramatic result of a billboard. To address this issue, product packaging can be constructed in a manner to reduce the appearance of the dispenser or cap relative to the overall packaging.

Embodiments of the present invention thus provide product packaging with larger printable areas on the container body as compared with traditional product packaging. One way some manufacturers eliminate the disadvantages of traditional product packaging is to place the packaging in another outer packaging. For example, with the traditional squeeze tube type packaging for toothpaste, instead of trying to maximize the advertizing space on the squeeze tube itself, the manufacturer packages the squeeze tube in a box. Although the entire surface of the box affords graphic space, boxes add undesired expense. In contrast, embodiments of the invention are capable of increasing advertising space directly on the container body itself. Especially preferred is packaging where the forward-facing surface of the product is maximized and any cap or dispenser portion is minimized. One way for maximizing the advertising space on the product is to increase the surface area of the container by internalizing part or all of the cap or dispenser portion of the product packaging.

Using this method, the package designer is no longer limited by traditional package shapes. Since the mechanism can be hidden inside the package, the possibility exists to design packages that do not exist today. We can imagine a presentation that looks good on the shelf in the store, and the appearance when displayed on the counter at home is enhanced. This is an important concept in the packaging industry now called "shelf to counter." For instance, a package could be shaped like a stylized flattened squeezable disk or like a small sphere. Since the dispenser is partially or completely hidden inside the package, the dispenser can act as the bottom "foot" for the package, keeping the package upright when not in use. Not only is this method appropriate for typical household dispenser packages, but could be used to produce novelty or advertising items in unique, branded shapes.

One of the challenges of the squeeze tube is that the front facing surface is rounded. This limits the front facing graphic space. That is, that only a portion of the package graphic space is available, since the surface of a traditional package curves away from the viewer. Especially when using the fused method, the package designer can use non-traditional dispenser shapes. Dispensers can be of any shape and size that meets the design and branding needs of the seller. Using methods and products of embodiments of the invention, the effect of a rounded surface when viewed from the front can be partially or completely eliminated. Dispensers can now be made in shapes not previously considered including round, oval, square, or triangular. For instance, if the package designer uses an oval dispenser, then the traditional squeeze tube package can be flattened along the entire vertical surface. The tube itself may need to be extruded in a shape other than round—in this example, oval when viewed as a cross section. The front facing graphic space that is visible when seen on the shelf is enhanced, since the package front is more flat than round. A package using a dispenser that is triangular can also achieve a similar effect, presenting one facet of the triangle to the consumer, and placing the two remaining surfaces toward the back of the shelf.

An alternate use, especially when using the fused package type, can use less material in the manufacture of the package. In such embodiments, since a more elaborate screw in type mechanism is eliminated, this will save manufacturing cost by using less plastic or whatever material is used. Since less package volume is taken by the dispensing mechanism, the package can hold more liquid or gel volume. This type of package could be used in promotions combined with advertising verbiage like, "10% more for the same price!" or "same size package—10% free!" The latter instance could be especially helpful when the package should fit into a specific space in the consumers home or business. This quantity of additional volume should be possible with smaller package sizes, like those used in cosmetics.

Figure 1B:
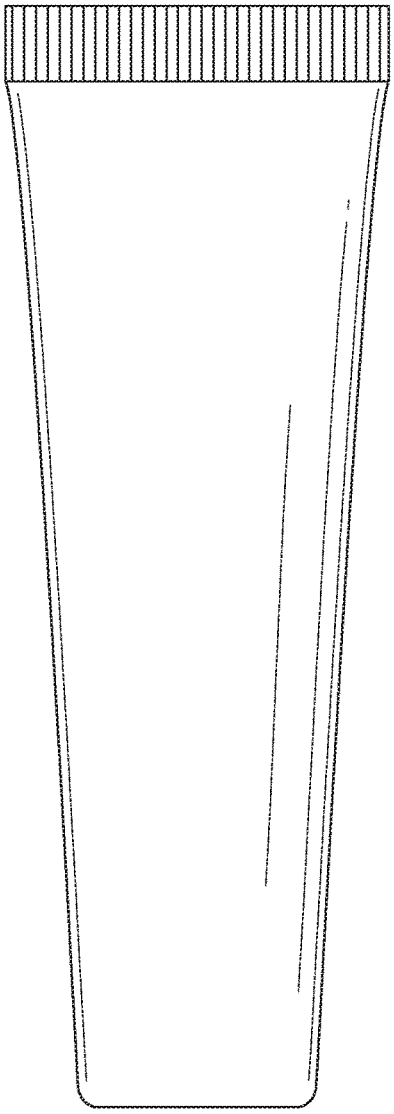

As shown in FIGS. 1A-B, one implementation of the invention is product packaging comprising a container body and a cap, or lid, wherein the cap is recessed in the body of the container and wherein the connection between the two parts is continuous and provides for an overall uniform container configuration. Traditional container caps, as shown in FIG. 1A, form a line when viewing the container that separates the package into two distinct parts, the container body and the lid. This interruption of the graphic space makes the package appear shorter, which visually implies that it contains less product by volume. By recessing the cap within the container (FIG. 1B), the separation of the container into two distinct parts is removed and the graphic space becomes uninterrupted, providing a uniform container. The product volume remains the same as well, however, the graphic space is now extended onto the portion of the packaging previously occupied by the cap.

The increased graphic space allows the manufacturer more room to display information about their product and enlarge their logo or other branding items. By recessing the cap into the container body, the graphic space can be increased by up to 50%. For example, while in FIG. 1A the cap occupies about 15% of the height of the packaging, by completely recessing the cap within the container body the cap can occupy less than 10% of the height of the overall packaging, such as 0% shown in FIG. 1B.

In preferred embodiments, product packaging is provided with a recessed cap and where the cap occupies from about 0-50% of package height, such as from about 1-40% of package height, such as from about 2-30%, or from about 3-25%, or from about 4-20%, or from about 5-18%, or from about 6-16%, or from about 7-14%, or from about 8-12%, or 9-11%, or 10% of package height. Package or product height in the context of this specification refers to the overall height of the total package, i.e., the container body and cap combined. By enlarging or adding graphics in this increased space, the product packaging becomes more noticeable to the consumer when viewed by the consumer on the shelf, giving the manufacturer a better chance of having their product selected over their competitor's product. Moreover, by gaining graphic space, the apparent volume of the container is increased thereby increasing the shelf presence of the product, even though the actual volume of the product remains about the same. Since consumers often make their product selection on the best value for a given amount, increasing the apparent volume will cause them to favor that particular product.

The body and cap may be composed of any material, with the preferred embodiment being composed of plastic such as Polyethylene (PE), including Low Density Polyethylene (LDPE), High Density Polyethylene (HDPE), Medium Density Polyethylene (MDPE), Polypropylene, Aluminum Barrier Laminate (ABL), and Plastic Barrier Laminate (PBL), etc. The packaging can also comprise combinations of plastic with glass or metal, such as a glass bottle with either a plastic or metal cap. Wood is also an option for either or both the container body and the cap. Moreover, the cap and body of the container may be composed of identical materials or any combination of materials.

FIGS. 2A-D illustrate various embodiments of recessing a cap within the body of a product container to increase the advertising space on the container body. These embodiments each allow for a container with a more uniform container configuration, such that the cap has a low profile or no profile with respect to the packaging height and is less noticeable to the consumer. With a less noticeable cap, or a cap that occupies only a small portion of the packaging height, the advertising space on the container body is increased and the apparent volume of the container body is increased, while the actual volume of the product can remain the same.

Figure 2A:
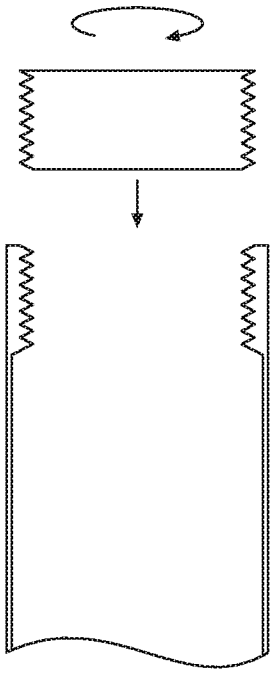
FIGS. 2A-D are drawings that illustrate various recessed caps.
Figure 2B:
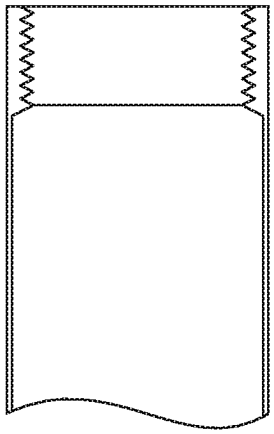

More particularly, as shown in FIG. 2A, a container body with threading on an internal surface of the container is operably configured to mate with a cap having cooperative threading on an external surface of the cap. When the externally threaded cap is screwed into the internally threaded container body, as shown in FIG. 2B, the traditional two piece package is eliminated and a seamless appearance between the container body and cap is provided. The cooperative threading can be disposed on an external surface of the cap and corresponding threading disposed on an internal surface of the container body.

When referring to internal and external surfaces in the context of this specification, what is meant is a surface facing inwardly within the component (internal) or a surface facing outwardly from the component (external). In preferred embodiments, rather than a "female" screw on top that is internally threaded and a "male" externally threaded container body, the connector sex is reversed. That is, the cap is the "male" component, which is externally threaded for screwing into the container body, which container body is operably configured to provide the cooperating "female" component that is threaded on an internal surface of the container body. Alternately, embodiments can comprise a "male" container body connector and a "female" cap. The cap and container can comprise any length or type of threading, so long as the threaded portion of the cap operably cooperates with the threaded portion of the container body. Additionally, the cap can be completely or partially recessed in the container when the cap is fully screwed into the product packaging. Screw in dispensers can be made removable by manufacturing a slot into the visible part of the dispenser. To remove the cap, the consumer can insert a coin or similar object into the slot. Turning the closure, say in a counterclockwise direction, could temporarily remove the dispenser so that the container could be refilled. Reversing the sequence could reclose the container.

Figure 2C:
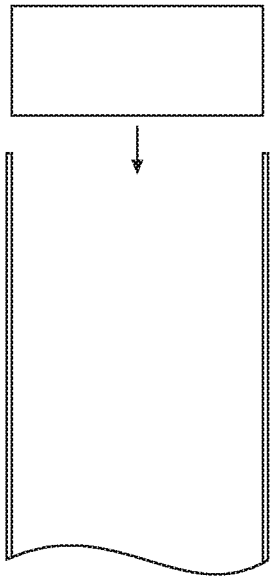

FIG. 2C illustrates a cap that is fused into the interior of the container body. The cap in this embodiment is again the "male" component, which is operably configured for mating with the "female" component provided by the container body. The cap is inserted into the container body where the external surface of the cap forming the sides of the cap are fused to the sides of the container body at its internal surface. The cap and body may be permanently or temporarily fused together by an adhesive or melting of the plastic together. Any other method of fusing the cap and container body can also be used. The cap and container body can be connected together where their engagement is releasable. Additionally, the cap may be partially recessed and partially fused with the container body, or may be fully recessed (where the cap does not add height to the packaging) and either completely or partially fused. For example, the cap and container body can be spot welded together at various portions around the circumference of the container body.

Figure 2D:
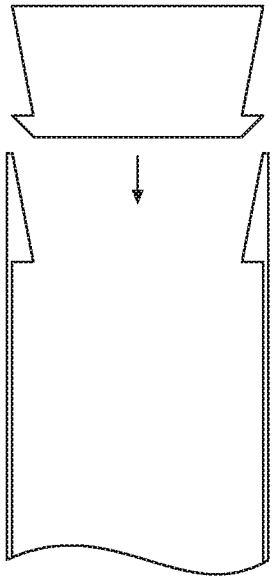

FIG. 2D illustrates a snap-in type cap in which the cap is snapped into the container body and retained therein. This packaging embodiment comprises a container body with a "female" connector portion comprising a ledge or other protrusion on the interior surface of the container body, which is operably configured to cooperate with a "male" cap comprising a tab or other cooperating structure on the outer surface of the cap, such that when the cap is inserted into the container body the tab is pushed passed the ledge to engage therewith and prevent the cap from being removed. In embodiments, the ledge can be a protrusion around the entire circumference of the container body or can be provided by a plurality of protrusions disposed around the internal circumference of the container body. As illustrated in FIG. 2D, the ledge or protrusion(s) can have a wedge shape cross section thus providing for a decrease in the internal diameter of the container body with depth of the ledge. This shape will cause an interference fit with the cooperating cap that comprises structure having a larger diameter and when inserted beyond the presence of the ledge will not be capable of being removed from the container body without substantial force.

Existing types of container closures can be used in embodiments of the invention, including flip caps, rocker-style openings, tab-type caps, and pump-type dispensers to name a few. Using conventional type openings and adapting them for use with embodiments of the invention accommodates consumer familiarity and may reduce manufacturing and design costs by being able to use existing components.

Figure 3A:
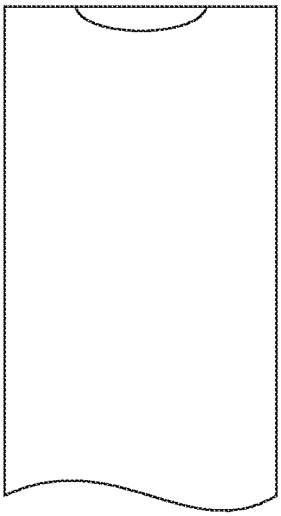
FIGS. 3A-C are drawings illustrating a flip cap of packaging embodiments of the invention, where the cap is completely recessed such that no height is added to the height of the overall packaging (FIGS. 3A-B) and where the cap is partially recessed (FIG. 3C).
Figure 3B:
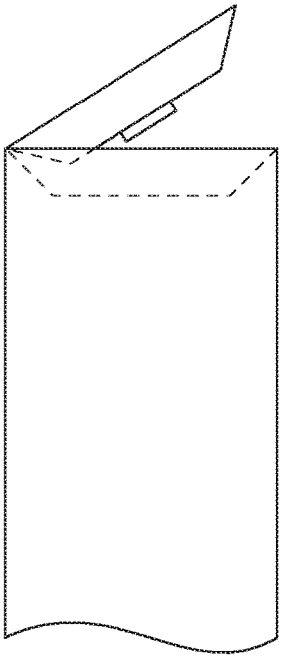
Figure 3C:
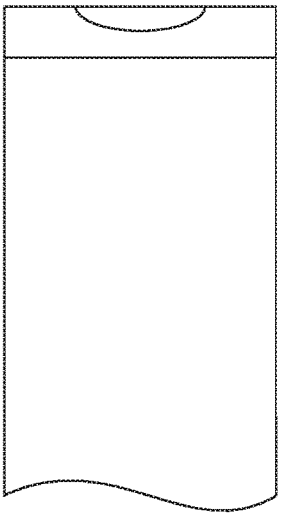

FIGS. 3A-C illustrate another embodiment of a cap of the invention. This is a flip type cap, which is operated by having a tab on the outside of the container body attached to a lid, which tab the consumer can push or lift up with a finger or finger nail to open the lid and dispense product. As shown in FIG. 3A, the flip type cap can comprise the tab on the front- or rear-facing surface of the container body. If disposed on the rear-facing surface and when the cap component is completely recessed within the container body, the cap has no visual impact on the front-facing surface. In such embodiments, the advertising space on the front surface of the container body is fully maximized. FIG. 3B illustrates the flip up cap in an open, active position for dispensing product. As shown, the lid comprises a "male" type protrusion for cooperating with and fitting by interference fit with a "female" type opening in the cap. The female opening is the opening in the cap through which product is dispensed. In embodiments, and as illustrated in FIG. 3B, the lid can comprise no additional tab that is disposed on the outside of the container body. Here, the user can insert a finger nail into the region between the lid and container body to pry open the flip up cap. As illustrated in FIG. 3C, the flip up cap can also be provided where a portion of the cap is recessed into the container body, thus providing for a low profile cap. Here, the partially recessed cap occupies no more than 5% of the product packaging height and thereby minimizes the aesthetic impact to the consumer.

Figure 4A:
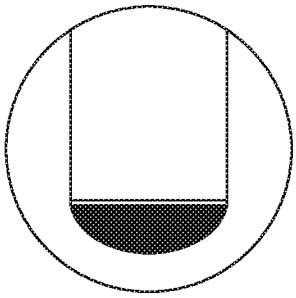
FIGS. 4A-D are drawings of various closures of recessed cap embodiments.
Figure 4C:
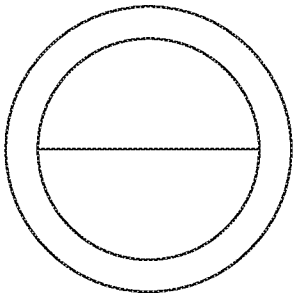
Figure 4B:
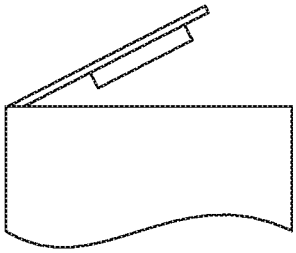

As shown in FIGS. 4A-B a tab type can be used. Preferred embodiments incorporate the tab type cap into product packaging by recessing a portion or all of the cap into the internal portion of a container body. The tab type cap can be operably configured for being screwed into, fused into, or snapped into the container body according the embodiments described above. The tab-type cap can comprise a hole for dispensing product through the cap when the tab is open. The tab can comprise structure for cooperating with, filling, and closing the hole, such that when the tab is closed the structure recesses into the hole and closes the hole by interference fit. A recess, cut out, or dimple can be provided in the top of the cap to accommodate the consumer's finger or finger nail to lift the tab into an active, open position. FIG. 4A illustrates an exemplary flip up cap with a tab, showing the tab in an inactive, closed position and disposed in close proximity to a recess in the top of the cap for leveraging a finger under the tab in order to open it and dispense product. FIG. 4B illustrates the tab type cap in a position after the consumer has used their finger to open the flip up cap. In this embodiment, the flip up cap, is partially or completely recessed within the container. The tab type flip up cap may be flush with the top of the recessed cap body or may extend partially above the recessed cap and thus may occupy only about 0-20% of the total height of the packaging.

Figure 4D:
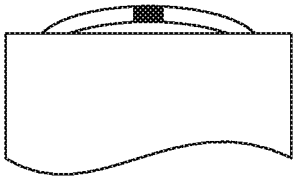

As shown in FIGS. 4C-D, the closure or cap can also be provided as a rocker-style cap. In such a cap, product is dispensed through an opening that faces in a direction other than normal to the cap top. When closed, FIG. 4C, the rocker top provides a flat surface on the top of the product packaging. The rocker cap comprises a hinge or other mechanism for allowing the disk-like top to shift to an active, open position where the top of the product packaging is now slanted or has a slope relative to the sides of the container body. For example, with this type of closure the user opens the cap by depressing one side of the cap which causes the other side, comprising the hole for dispensing product, to rise above the side of container, FIG. 4D. This rocker style cap can also be partially or totally recessed within the container body, such that the cap, when in a closed position, does not add height to the overall product packaging, or adds very little height, such as between 0-5% of the product packaging height.

Figure 5C:
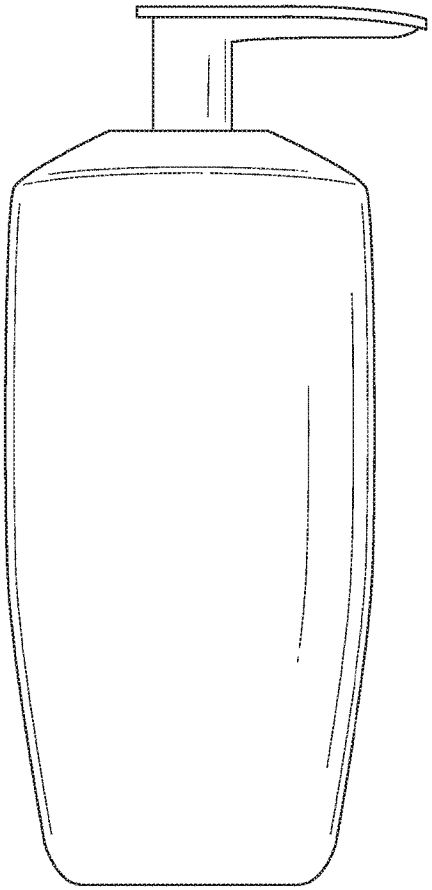
FIGS. 5B-C are images of embodiments of the invention with a recessed pump closure, showing how the overall height of the packaging can be reduced, while maintaining the actual and/or apparent volume of the container body.
Figure 5B:
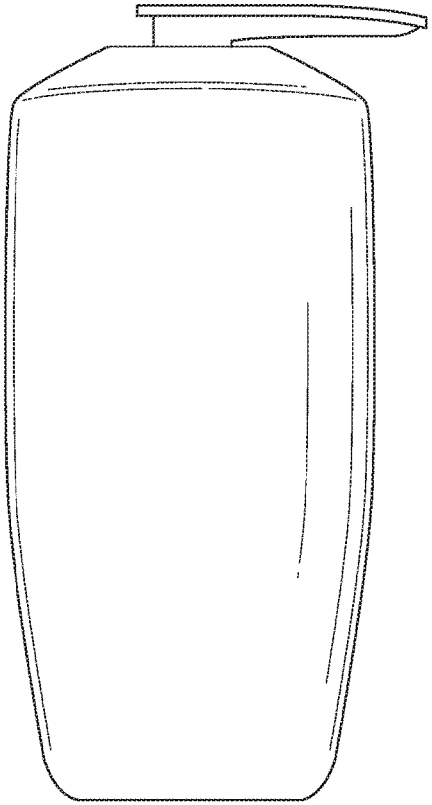
Figure 5A:
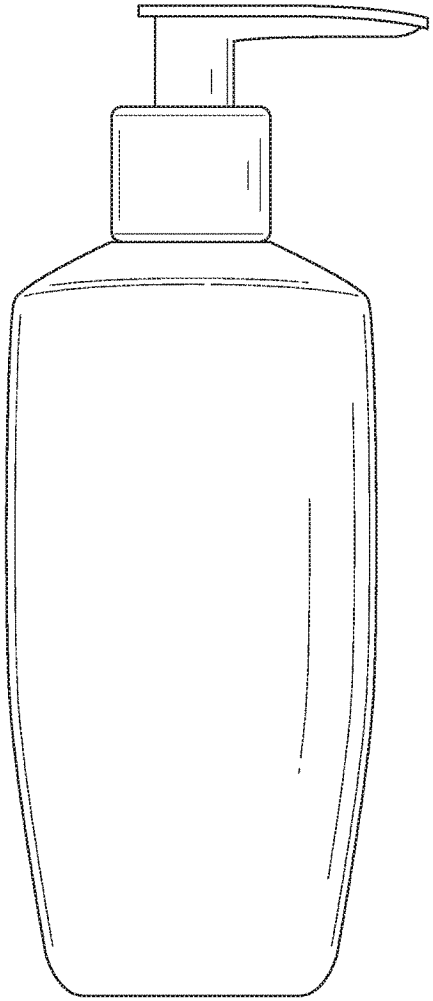
FIG. 5A is an image of a prior art container with a pump closure.

Product container embodiments with recessed caps can also comprise pumps for dispensing product from the container, such as the one shown in FIGS. 5B-C. Compared to the conventional container depicted in FIG. 5A, both bottles contain the same finger pump, however, in FIGS. 5B-C the pump mechanism has been recessed within the container body. More specifically, in FIG. 5B the recessed pump is shown in a closed, inactive position, while the pump in FIG. 5C is shown in the active, open position. The pump can be configured similar to existing pump type closures, where for example the pump is changed from active to inactive status by screwing the pump dispenser into the cap to a locked position. The recessed pump maintains pump functionality, while decreasing the overall height of the product packaging. For example, as shown, the recessed pump can decrease the overall height of the product packaging by about 10-25%, as here the pump when closed (FIG. 5B) contributes less than about 2-5% to the overall height of the product packaging. Such products have the advantage of occupying less shelf space and volume when shipped. Alternatively, to maintain the same height as that shown in FIG. 5A, the container body can be increased so that the overall height of the packaging is the same, thereby increasing the volume or apparent volume of the packaging, as well as the surface area on the outside of the packaging (e.g., advertising space), even though the volume or apparent volume remains the same. Such an increase in apparent volume and/or an increase in the advertising space (e.g., front-facing surface of the container) on the surface of the container body is expected to lead to an increase in product sales.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention. Where a range of values is provided in this specification, each value between the upper and lower limits of that range is also specifically disclosed. The upper and lower limits of these smaller ranges may independently be included or excluded in the range as well. As used in this specification, the singular forms "a," "an," and "the" include plural referents unless the context clearly dictates otherwise. It is intended that the specification and examples be considered as exemplary in nature and that variations that do not depart from the essence of the invention are intended to be within the scope of the invention. Further, the references cited in this disclosure are incorporated by reference herein in their entireties.

The invention claimed is:

1. A product packaging comprising:

(a) a squeeze-tube container body with a selected height, the squeeze-tube container body comprising i) an opening with a threaded internal surface operably configured for receiving a cap and ii) a crimped end which opposes the opening; and (b) a cap with an external surface that is threaded in a manner to provide for connection with the threaded internal surface of the squeeze-tube container body opening and configured to provide a through-hole within a top surface of the cap and extending through the cap, wherein such through-hole is capable of dispensing product, and comprising a closure connected to the cap by way of a hinged-end for closing the through-hole;

(c) wherein, when the container body and the cap are connected as product packaging, the cap and closure are completely recessed into the container body and the cap adds no height to the product packaging, which configuration provides for a continuous uninterrupted graphic space on the product packaging such that indicia disposed on the product packaging is disposed on the container body at a point where the container body surrounds the recessed cap; and (d) wherein upon visual inspection a front elevation view of the product packaging has no visible junction between the container body opening and the container body.

2. The product packaging of claim 1, wherein the external threaded surface of the cap is male threaded and the threaded internal surface of the container body opening is cooperatively female threaded.

3. The product packaging of claim 1, wherein the container body and the cap both comprise plastic.

4. The product packing of claim 1, wherein the squeeze tube has an oval shape when viewed as a cross-section.

5. The product packaging of claim 1, wherein the external surface of the cap that is threaded extends to the top surface of the cap.

6. The product packaging of claim 1, wherein the internal surface of the container body opening that is threaded extends to a top of the container body.

7. The product packaging of claim 1, wherein when the container body and cap are connected as product packaging, the internal threaded surface of the container body and the external threaded surface of the cap are cooperatively engaged from a top of the product packaging through a portion of the product packaging occupied by the cap.

8. The product packaging of claim 1, wherein the container body and cap are composed of identical materials.

9. The product packaging of claim 1, wherein when the container body and cap are connected as product packaging, the through-hole extends from the top surface of the cap to an interior of the container body.

10. The product packaging of claim 1, wherein the container body opening and the cap comprise structure which prevents removal of the cap after connection of the cap with the container body opening.

11. The product packaging of claim 1, wherein the closure comprises a tab with structure capable of cooperating with and closing the through-hole, such that when the tab is closed the structure recesses into the though-hole and closes the through-hole by interference fit.

12. The product packaging of claim 1, wherein the closure has a terminal end which opposes the hinged-end, wherein the distance between the hinged-end and terminal end is less than the diameter of the cap.

13. The product packaging of claim 12, wherein the cap comprises a recess proximal to the terminal end of the closure, which recess is dimensioned to accommodate a user's finger or fingernail for leveraging the closure in an open position.

* * * * *